US005441278A

United States Patent [19]

Nalder

[11] Patent Number: 5,441,278

[45] Date of Patent: Aug. 15, 1995

[54] APPARATUS AND METHOD OF PLAYING AN EDUCATIONAL CARD GAME

[76] Inventor: Gregory T. Nalder, 2057 Monaco Way, Meridian, Id. 83642

[21] Appl. No.: 333,064

[22] Filed: Nov. 1, 1994

[51] Int. Cl.[6] ..... A63F 1/00

[52] U.S. Cl. ..... 273/296; 273/299; 273/293; 434/209

[58] Field of Search ..... 273/299, 293, 296, 240; 434/209

[56] References Cited

U.S. PATENT DOCUMENTS

| | | | |
|---|---|---|---|
| 1,246,152 | 11/1917 | Perrine | 273/296 |
| 1,584,062 | 5/1920 | Williamson | 273/299 |
| 2,198,670 | 4/1940 | Johnson | 273/299 |
| 3,501,854 | 3/1970 | Hollingsworth | 273/299 |
| 3,618,231 | 11/1971 | Nason | 273/299 |

*Primary Examiner*—Benjamin H. Layno
*Attorney, Agent, or Firm*—Frank J. Dykas

[57] ABSTRACT

An educational game for teaching the fundamentals of dimensional analysis, including a chip imprinted with an equal sign, and at least one set of cards. Each set of cards includes at least three (3) cards, each card having first and second faces, each face imprinted with a line bisecting the face to form top and bottom generally rectangular halves. On each card a first symbol is imprinted on the top half of the first face and the same symbol is imprinted on the bottom half of the second face, while a different symbol is imprinted on the bottom half of the first face and that symbol is also imprinted on the top half of the second face. Each symbol appears on an even number of cards. To play the game, one card, denoted the target card, is placed on a surface to the right of the equal sign chip, while the remaining cards are arranged in random order in a row to the left of the equal sign chip, with random faces exposed and the corresponding second faces hidden, the bisecting line of all cards being generally colinear. The cards to the left of the equal sign chip are then, if necessary, flipped to expose the hidden faces until the symbol on the top half of each source card is matched by a symbol on the bottom half of another source card, except for one top half symbol and one bottom half symbol, which match the top half and bottom half symbols, respectively, of the target card.

9 Claims, 5 Drawing Sheets

APPARATUS AND METHOD OF PLAYING AN EDUCATIONAL CARD GAME

BACKGROUND OF THE INVENTION

1. Technical Field

This invention relates generally to games. More particularly, this invention relates to an educational card game for teaching the technique of dimensional analysis.

2. Background

Many math problems encountered in daily life and on scholastic tests involve ratios, a ratio being a value expressed using the word "per." Examples include "miles per hour" or "calories per serving." Some of these problems are familiar and simple. For instance, "If Bill drives 250 miles on 10 gallons of gas, how many miles per gallon did Bill's car get?" Most people know how to divide miles by gallons to get miles per gallon. However, not all problems are so simple. For example, "If a baseball player throws a pitch 15 meters and it takes the ball one second to get to the catcher, what is the speed of the pitch in miles per hour?" Or, "If Tom drives 60 miles per hour and drives 8 hours per day, how many weeks will it take him to drive the 3,000 miles from San Francisco to New York City?"

Dimensional analysis provides a powerful way of solving these types of problems. Essentially, the technique entails multiplying known quantities by dimensional equivalence ratios, a dimensional equivalence ratio being a fraction equal to one, such as "7 days/1 week." Then like units are cancelled from the numerator and denominator of the ratios to arrive at a result with the desired dimensions. For example, applying dimensional analysis to the last problem above, it is apparent that the desired result, or target, units are weeks, because the answer sought is how many weeks it will take Tom to drive the 3,000 miles from San Francisco to New York City. Also, given information includes ratios of 60 miles per hour and 8 hours per day, and that the distance is 3,000 miles. Because none of the given ratios or quantities contain units of weeks, it is apparent that multiplication by a dimensional equivalence ratio involving weeks is necessary. For instance, one week per seven days appears to be a suitable choice here.

Placing the desired target units of weeks on the right side of the equal sign, and placing our first ratio of one week per seven days on the left, the remaining given information ratios are multiplied and appropriately arranged on the left side of the equation so that all the units cancel out, leaving only the desired dimensions of weeks, as shown here:

$$3{,}000 \text{ miles} \times 1 \text{ hour}/60 \text{ miles} \times 1 \text{ day}/8 \text{ hours} \times 1 \text{ week}/7 \text{ days} = 0.9 \text{ weeks}$$

Thus, it is seen that dimensional analysis can be used to easily solve these types of problems. Unfortunately, dimensional analysis is not taught in most school courses.

The object of the present invention is to teach the fundamentals of dimensional analysis using an educational game. It is a further object of the present invention to teach the fundamentals of dimensional analysis in a way that is entertaining and easy.

DISCLOSURE OF INVENTION

These objects, along with others, are accomplished by means of an educational card game, including a chip having an equal sign imprinted on its face and one or more sets of cards. Each set includes at least three cards, each card having front and back faces. The front and back faces of each card are bisected by a line which divides each space into generally rectangular top and bottom halves. The top and bottom halves are denoted the numerator and denominator, respectively.

On each card, the numerator of the front face is imprinted with a first symbol, while the denominator of the front face is imprinted with a second symbol. On the back face of that card, the numerator is imprinted with the second symbol, while the denominator is imprinted with the first symbol. The symbols are imprinted on the back face such that when the card is rotated or flipped once about an axis parallel to the bisecting line, i.e., end over end, the numerator appears above the denominator. Each symbol appears on an even number of cards. The symbols may be representations of everyday objects, such as a flag, a telephone, or a pair of scissors. Alternatively, the symbols may be words representing actual units, such as miles and hours, such that a card with numerator miles and denominator hours represents the ratio "miles per hour."

To play the standard version of the game, one set of cards is selected and laid out in random order and with random faces exposed, on a surface such as a table, in a row, with the dividing line of each card generally colinear. An equal sign chip is placed between the penultimate and last card to the right. The cards to the left of the equal sign chip are denoted source cards, while the card to the right of the equal sign chip is denoted the target card. The object of the game is to arrange the source cards such that the symbol in the numerator of each source card is matched, or cancelled, by the symbol in the denominator of another source card, until only one numerator symbol on one source card and one denominator symbol in another source card remain which exactly match the numerator and denominator symbols, respectively, on the target card.

The game is played by sequentially flipping selected source cards end over end to reveal the downward-facing face. The selection and order of cards to be flipped is the choice of the player. The game is finished, or won, when all the source card numerator symbols are matched, or cancelled, by other source card denominator symbols, leaving only one uncancelled source card numerator symbol, which matches the target card numerator symbol and one uncancelled source card denominator symbol, which matches the target card denominator symbol.

In the standard version of play and in other variations, the invention teaches the fundamentals of matching and cancelling the numerators and denominators of ratios to arrive at a ratio or result with the desired units. When ratios with actual units and numerical values are used, the invention can be used to solve real world problems.

BEST MODE FOR CARRYING OUT INVENTION

Figure 1:
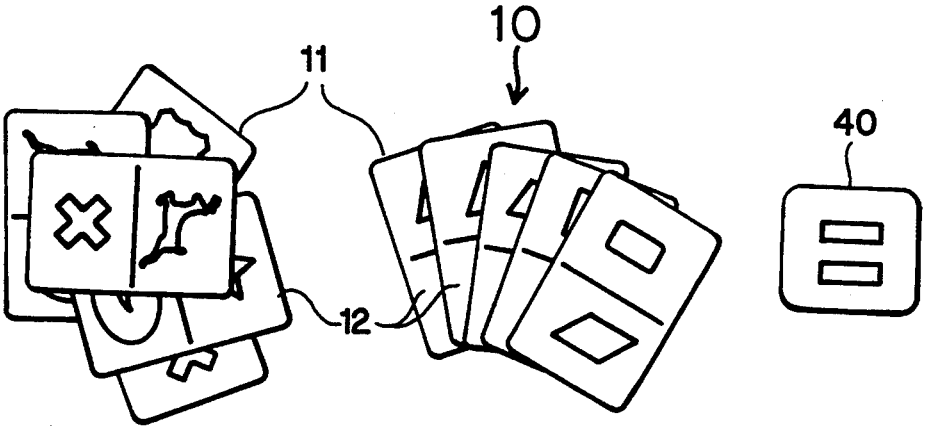
FIG. 1 is an expanded plan view of the game, showing two sets of cards and an equal sign chip.

Referring now in greater detail to the various figures of the drawings, an educational game embodying the present invention is shown at 10 in FIG. 1. The game 10 basically consists of at least one chip 40 imprinted with an equal sign and one or more sets 11 of cards 12.

Figure 2A:
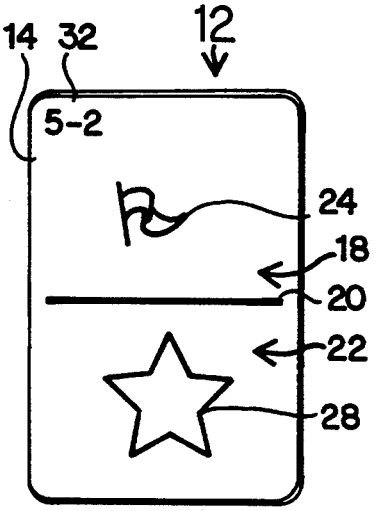
FIG. 2A is a perspective view of one of the game cards, showing the first face.
Figure 2B:
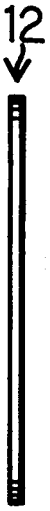
FIG. 2B is a sectional view of one of the game cards.

Referring to FIG. 2, each set 11 of cards 12 consists of at least three cards, each card having first and second faces, 14 and 16 respectively. The first face 14 and second face 16 are imprinted with a dividing line 20 which bisects each face into essentially rectangular top and bottom halves denoted numerator 18 and denominator 22, respectively. The numerator 18 of the first face 14 of a given card 12 is imprinted with a first symbol 24. The denominator 22 of the first face 14 of the card 12 is imprinted with a second symbol 28. The numerator 18 of the second face 16 of the card 12 is imprinted with the same second symbol 28, while the denominator 22 of the second face 16 of the card 12 is imprinted with the same first symbol 24.

Figure 2C:
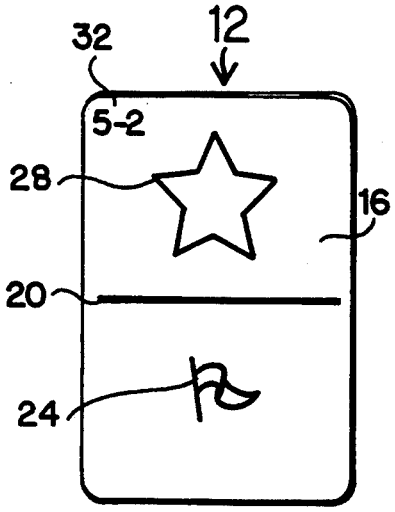
FIG. 2C is a perspective view, showing the second face of the card of FIG. 2A.

The first symbol 24 and second symbol 28 are imprinted on the card 12 in a manner so that when a card 12 is lying on a horizontal surface, such as a table, with the first face 14 exposed and the card 12 is rotated or flipped about an axis parallel to the dividing line 20 to expose the second face 16, the symbols appear interchanged, as compared to the symbols on the first face, with respect to the dividing line 20, as shown in FIGS. 2A and 2C.

In any given set 11 of cards 12, the first symbol 24 and the second symbol 28 of a specific card each appear on at least two cards, but the symbols appear together on only one card. Any one symbol appears on an even number of cards. Each set 11 of cards contains at least three cards 12. Each card 12 of a set 11 of cards is denoted by numerical designation imprinted on the face of the card of the form "n-x" where n denotes the number of cards in the set and x denotes that the set is the xth set of n-card sets. For example, for a card imprinted with "5-2" the "5" denotes that the set is provided with five cards; the "2" denotes that the set is the second set of five-card sets.

Figure 3:
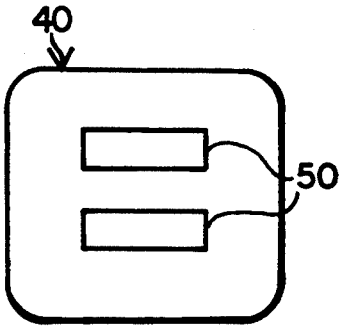
FIG. 3 is a perspective view of an equal sign chip.

The game is also provided with at least one chip 40 imprinted with an equal sign 50, as shown in FIG. 3.

Figure 4:
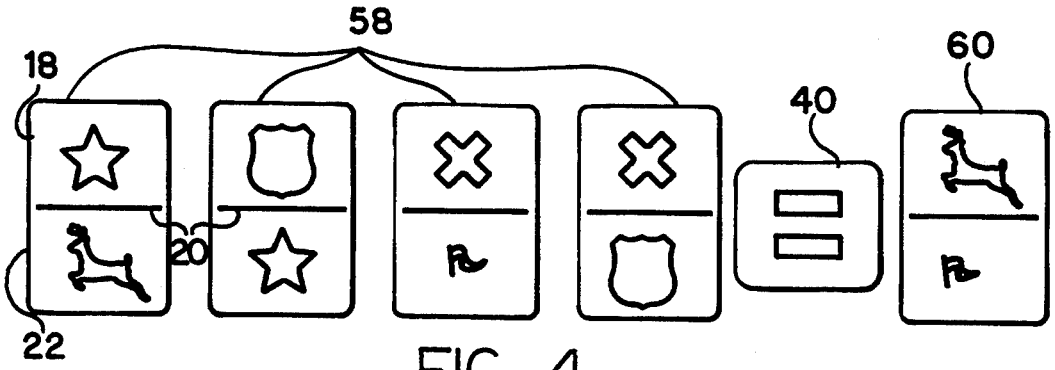
FIG. 4 is an expanded plan view, showing the cards and chip arranged to play the standard version of the game.

To set up to play the standard version of the game, one set 11 of cards is selected and laid out in random order with random faces exposed, in a row, with the dividing line 20 of each card 12 generally colinear, as shown in FIG. 4. An equal sign chip 40 is placed between the penultimate and last card to the right, as shown in FIG. 4. The cards to the left of the equal sign chip 40 are denoted source cards 58, while the card to the right of the equal sign chip is denoted the target card 60. The object of the game is to arrange the source cards 58 such that the symbol in the numerator 18 of each source card is matched, or cancelled, by the symbol in the denominator 22 of another source card, until only one numerator symbol of one source card and one denominator symbol or another source card remain which exactly match the numerator and denominator symbols, respectively, on the target card 60.

The game is played by sequentially flipping selected source cards 58 about an axis parallel to the card's dividing line 20 to reveal the hidden second face 16. The selection and order of cards to be flipped is the choice of the player. As many as all the source cards 58 or as few as none of the source cards may need to be flipped before the game is finished. The game is finished, or won, when the numerator 18 symbol of each source card 58 is matched, or cancelled, by the denominator 22 symbol of another source card, leaving one source card with numerator symbol matching the numerator symbol of the target card 60, and one source card with denominator symbol matching the denominator symbol of the target card.

In the preferred method of playing the game, the first source card 58 to be selected, and flipped if necessary, is that card which will result in its numerator 18 symbol matching the numerator symbol of the target card 60. This source card is then "locked", i.e., never flipped again. The next source card 58 to be selected, and flipped if necessary, is that source card which will result in its denominator 22 symbol matching the denominator symbol of the target card 60. This source card is likewise then "locked", or never flipped again. The remaining source cards are then selected and flipped as necessary until each of their numerator 18 symbols is cancelled by the denominator 22 symbol of another source card.

Figure 5:
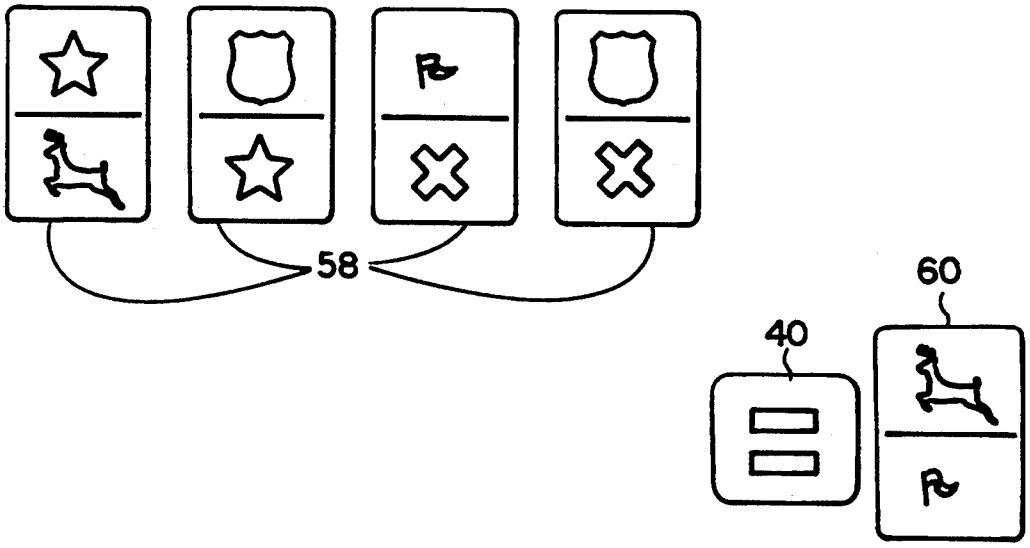
FIG. 5 is an expanded plan view, showing the cards and chip arranged to play an alternate version of the game.

Another, alternate method of playing the game is shown in FIG. 5. Here, one card of the set is selected to be the target card 60 and placed to the right of the equal sign chip 40. The remaining cards of the set, designated source cards 58, are arranged in random order with random faces exposed, in a row above and to the left of the equals chip and target card. To play the game, an appropriate source card 58 is selected, flipped if necessary, and placed immediately to the left of the equals sign chip 40 such that this source card's numerator 18 symbol matches the numerator symbol of the target card 60. Next, an appropriate second source card 58 is selected, flipped if necessary, and placed immediately to the left of the first source card selected so that the numerator symbol 18 of the second source card matches the denominator symbol 22 of the first source card selected. Then an appropriate third source card is selected, flipped if necessary, and placed immediately to the left of the second source card selected so that the numerator symbol of the third source card matches the denominator symbol of the second source card selected. Play proceeds in this way until all source cards have been selected and placed, and the denominator 22 symbol of the last source card 59 placed matches the denominator symbol of the target card 60.

Figure 6:
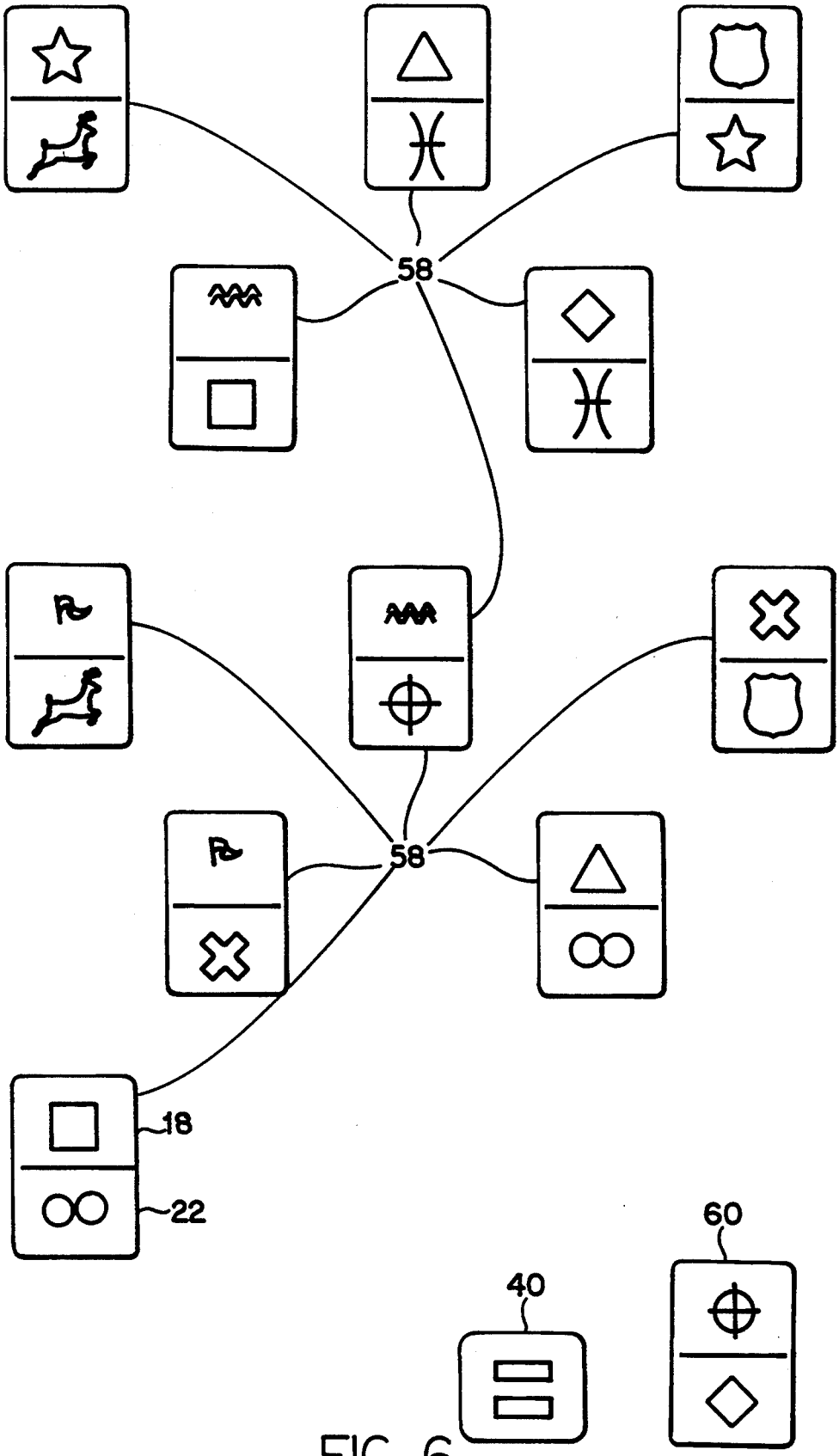
FIG. 6 is an expanded plan view, showing the cards and chip arranged to play the more difficult version of the game.

In another, more difficult version of the game, two or more sets of cards are chosen and arranged in random fashion with random faces exposed, as shown in FIG. 6. One card is selected and placed to the right of the equal sign chip 40. This card is the target card 60. The remaining cards are source cards 58. Source cards are then selected, one by one, flipped as necessary, and placed to the left of the equal sign chip, as previously described. The game is over when the numerator 18 symbol of each selected source card 58 is cancelled by the denominator 22 symbol of another selected source card, except for the one numerator and one denominator symbol which match the numerator and the denominator, respectively, of the target card 60. The difficulty of this version of the game is that only source cards from the same set as the target card may be played, and must be chosen from the randomly arranged group of source cards.

The first and second symbols used in the numerator 18 and denominator 12 of each card 12 of each set may be a variety of figures, pictures or words. For example, everyday items, such as a flag, a telephone or a pair of scissors, may be depicted. Alternatively, words denoting actual relationships or ratios between the numerator and denominator of the cards may be used. For example, "miles per hour" may be depicted on a card having numerator and denominator of miles and hours, respectively; and "hours per day" may be depicted on a card having numerator and denominator of hours and days, respectively. Sets of cards using such real world units can be used to solve real world problems.

An example of a real world problem that can be solved using the game, with a set of cards with real units, is as follows:

> Mary has a new job tutoring English. She is paid $3,000 for the school year. The school year lasts for 36 weeks and Mary can only work 3 days each week. Each day that she works, she works for 4 hours. She wants to know how much she is being paid per hour.

Figure 7A:
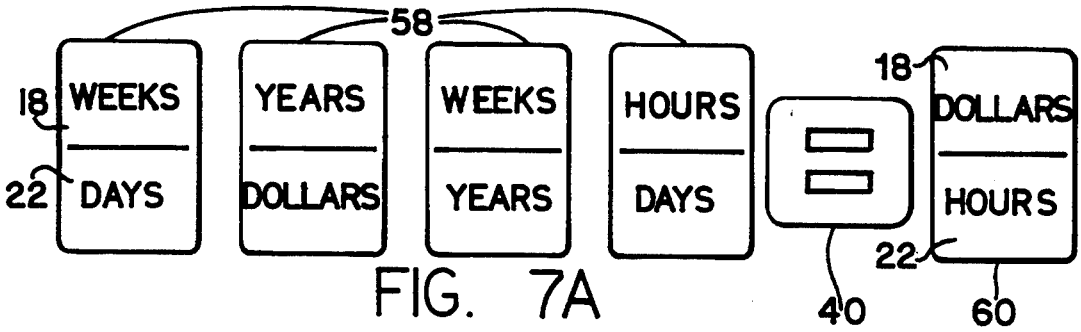
FIG. 7A is an expanded plan view, showing the cards and chip arranged for solving a real world problem,.
Figure 7B:
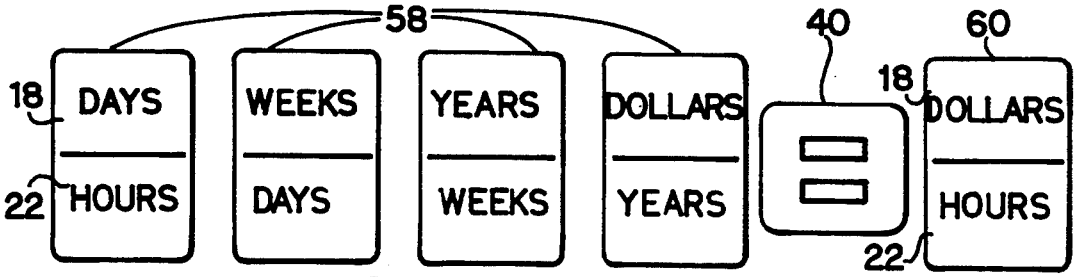
FIG. 7B is an expanded plan view, showing the cards and chip arranged after playing the game to solve a real world problem.

To solve this problem, a set 11 of cards with appropriate symbol units, such as that shown in FIG. 7A, is used. Because the desired result is in units of dollars per hour, a card having dollars in the numerator 18 and hours in the denominator 22 is placed to the right of the equal sign chip 40 to become the target card 60, as shown in FIG. 7A. The game is played, as discussed above, until the cards are arranged as shown in FIG. 7B, with the numerator 18 symbol of each source card 58 being cancelled by the denominator 22 symbol of one other source card, leaving only one source card numerator symbol, dollars, matching the dollars numerator symbol on the target card, and one source card denominator symbol, hours, matching the hours denominator symbol on the target card.

Figure 7C:
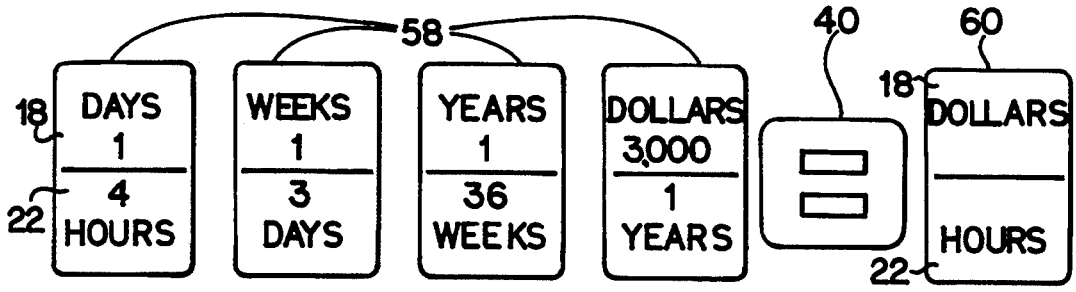
FIG. 7C is an expanded plan view of the cards and chip of FIG. 7B, showing real world numerical values written on the card faces.

Next, numbers are written on the source cards 58 at the appropriate units to correspond with the information given in the problem. For instance, "3,000" is written in next to "dollars" and "1" is written next to "years" on the dollars/years source card 58, indicating $3,000/yr., as shown in FIG. 7C. Finally, all the numerator 18 numbers for the source cards 58 are multiplied together and then divided by the product of all the source card denominator 22 numbers, giving the numerical solution to the problem, $6.94/hour.

To facilitate this type of real world problem solving, the cards 12 in the sets 11 imprinted with real world units may be provided with sufficient space for writing in the numerical values in the given problem. Furthermore, the cards may be provided with erasable first faces 14 and second faces 16, such as those suitable for using grease pencils or other erasable writing means. In this way, the same card sets can be used repeatedly for solving different numerical value problems.

Figure 8:
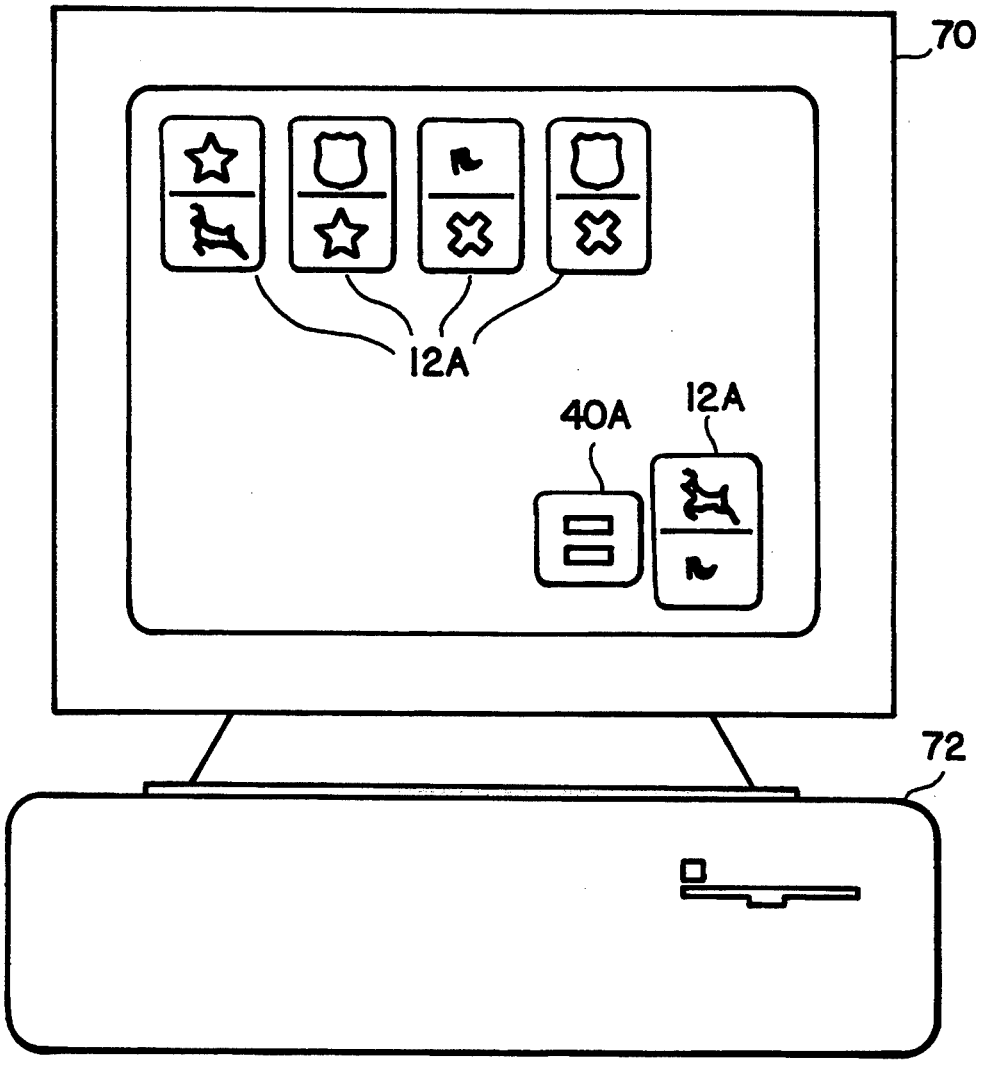
FIG. 8 is a perspective view of the game embodied on a computerized system.

Referring to FIG. 8, in another embodiment of the invention the cards 12 and chip 40, rather than being physical objects, are electronically-displayed objects, denoted 12A and 40A, on the monitor screen 70 of a computer or video game apparatus, denoted generally here as computerized system 72. To play the game, the cards 12A and chip 40A are manipulated electronically using an input device such as a keyboard, mouse or joystick.

Herein I have shown and described only the preferred embodiment of the invention, simply by way of illustration of the best mode contemplated by me in carrying out my invention. As will be realized, the invention is capable of other and different embodiments, and its several details are capable of modifications in various obvious respects, all without departing from the invention. Accordingly, the drawings and description are to be regarded as illustrative in nature, and not as restrictive.

I claim:

1. A game for teaching the fundamentals of dimensional analysis comprising:

(a) at least one set of playing pieces, each set comprising at least three (3) cards, each card having first and second faces, each face imprinted with a line bisecting the face to form top and bottom generally rectangular halves, denoting numerator and denominator, respectively, the numerator of the first face imprinted with a first symbol, the denominator of the first face imprinted with a second symbol, the numerator of the second face imprinted with the second symbol, the denominator of the second face imprinted with the first symbol, so that the numerator of each face appears vertically above the denominator when the card is rotated about an axis parallel to the line bisecting the face, each symbol appearing on an even number of cards; and (b) at least one chip imprinted with an equal sign.

2. The game of claim 1 wherein the symbols imprinted on the faces are everyday objects, such as a telephone, a flag, or a pair of scissors.

3. The game of claim 1 wherein the symbols imprinted on the faces are words representing units, such as "miles" and "hours," so that the numerators and denominators of the cards represent ratios, such as "miles per hour," for solving real problems.

4. The game of claim 1 wherein each set comprises five (5) cards.

5. The game of claim 1 wherein the card faces are provided with writable, erasable surfaces which can be reused for writing in numerical values.

6. The game of claim 1 wherein each card of a set is imprinted with a numerical designation of the form "n-x", where "n" denotes that the set contains n number of cards, and the "x" denotes that the set is the xth set of n-card sets.

7. A method of teaching the fundamentals of dimensional analysis using a chip imprinted with an equal sign, and at least one set of cards, each set comprising a plurality of cards, each card having first and second faces, each face imprinted with a line bisecting the face to form generally rectangular top and bottom halves, denoted numerator and denominator, respectively, the numerator of the first face imprinted with a first symbol, the denominator of the first face imprinted with a second symbol, the numerator of the second face imprinted with the second symbol, the denominator of the second face imprinted with the first symbol so that the numerator of each face appears vertically above the denominator when the card is rotated about an axis parallel to the line bisecting the face, each symbol appearing on an even number of cards, which comprises:

(a) lining up the cards of a set in a row in random order, with random faces exposed and the corresponding second faces hidden, and with the lines bisecting the card faces generally colinear;

(b) interdisposing the chip between the last card from the right and the other cards to designate a target card on the right side of the chip and source cards on the left side of the chip;

(c) flipping source cards about axes parallel to the lines bisecting the card faces to expose the hidden face as necessary until the symbol in the numerator of the target card is matched by the symbol in the numerator of one source card, and the symbol in the denominator of the target card is matched by the symbol in the denominator of one source card; and (d) flipping the remaining source cards until the symbol in the numerator of each source card is matched by the symbol in the denominator of another source card.

8. A method of teaching the fundamentals of dimensional analysis using a chip imprinted with an equal sign, and at least one set of cards, each set comprising a plurality of cards, each card having first and second faces, each face imprinted with a line bisecting the face to form generally rectangular top and bottom halves, denoted numerator and denominator, respectively, the numerator of the first face imprinted with a first symbol, the denominator of the first face imprinted with a second symbol, the numerator of the second face imprinted with the second symbol, the denominator of the second face imprinted with the first symbol so that the numerator of each face appears vertically above the denominator when the card is rotated about an axis parallel to the line bisecting the face, each symbol appearing on an even number of cards, which comprises:

(a) lining up the cards of a set in a row in random order with random faces exposed and the corresponding second faces hidden, with the lines bisecting the card faces generally colinear;

(b) randomly selecting one card of the set and placing it to the right of the chip on a different, generally parallel row, this card being denoted as the target card, and the remaining cards being denoted the source cards;

(c) selecting a source card, if necessary flipping it about an axis parallel to the line bisecting the card face and placing the card immediately to the left of the chip, such that this source card's numerator symbol matches the numerator symbol of the target card;

(d) selecting another source card, flipping it if necessary, and placing it immediately to the left of the last source card placed, so that this source card's numerator symbol matches the denominator symbol of the last source card selected and placed, until all source cards have been selected and placed.

9. A method of teaching the fundamentals of dimensional analysis using a chip imprinted with an equal sign, and at least one set of cards, each set comprising a plurality of cards, each card having first and second faces, each face imprinted with a line bisecting the face to form generally rectangular top and bottom halves, denoted numerator and denominator, respectively, the numerator of the first face imprinted with a first symbol, the denominator of the first face imprinted with a second symbol, the numerator of the second face imprinted with the second symbol, the denominator of the second face imprinted with the first symbol, each symbol appearing on an even number of cards, which comprises:

(a) arranging two or more sets of cards on a surface in random fashion, with random faces exposed and the corresponding second faces hidden;

(b) selecting one card and placing it on the surface to the right of the chip, this card being denoted the target card, the remaining cards being denoted the source cards;

(c) selecting a source card, if necessary flipping it about an axis parallel to the line bisecting the face and placing it immediately to the left of the chip, such that this source card's numerator symbol matches the numerator symbol of the target card;

(d) sequentially selecting the remaining source cards, flipping each if necessary, and placing the card to the left of the last source card selected so that this source card's numerator symbol matches the denominator symbol of the last source card selected and placed, until the denominator of the last source card placed matches the denominator of the target card.

* * * * *